US008147031B2

(12) United States Patent
Shinoda

(10) Patent No.: US 8,147,031 B2
(45) Date of Patent: Apr. 3, 2012

(54) RECORDING APPARATUS

(75) Inventor: Akira Shinoda, Obu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 558 days.

(21) Appl. No.: 12/361,397

(22) Filed: Jan. 28, 2009

(65) Prior Publication Data

US 2009/0189944 A1 Jul. 30, 2009

(30) Foreign Application Priority Data

Jan. 29, 2008 (JP) ..... 2008-017144

(51) Int. Cl.
*B41J 2/165* (2006.01)

(52) U.S. Cl. ..... 347/32; 347/22; 347/29

(58) Field of Classification Search ..... 347/22, 347/29–33, 36–37
See application file for complete search history.

(56) References Cited

U.S. PATENT DOCUMENTS

| | | | | |
|---|---|---|---|---|
| 6,260,943 | B1 * | 7/2001 | Ishikawa | 347/32 |
| 7,581,811 | B2 * | 9/2009 | Katayama | 347/29 |
| 7,766,449 | B2 * | 8/2010 | Watanabe | 347/29 |
| 7,798,597 | B2 * | 9/2010 | Chikamoto | 347/20 |
| 7,824,007 | B2 * | 11/2010 | Chikamoto et al. | 347/33 |
| 2006/0103690 | A1 | 5/2006 | Katayama | |

FOREIGN PATENT DOCUMENTS

| | | | |
|---|---|---|---|
| JP | H10-181040 | A | 7/1998 |
| JP | 2002-292886 | A | 10/2002 |
| JP | 2003-159822 | A | 6/2003 |
| JP | 2004-034478 | A | 2/2004 |
| JP | 2004-122423 | A | 4/2004 |
| JP | 2005-007253 | A | 1/2005 |
| JP | 2005-111938 | A | 4/2005 |
| JP | 2005-111939 | A | 4/2005 |
| JP | 2006-051679 | A | 2/2006 |
| JP | 2006-137139 | A | 6/2006 |
| JP | 2007-090554 | A | 4/2007 |
| JP | 2007-216466 | A | 8/2007 |

OTHER PUBLICATIONS

Japan Patent Office, Notification of Reason for Refusal for Japanese Patent Application No. 2008-017144 (counterpart to above-captioned patent application), dispatched Oct. 25, 2011.

* cited by examiner

*Primary Examiner* — Geoffrey Mruk
(74) *Attorney, Agent, or Firm* — Baker Botts L.L.P.

(57) ABSTRACT

A recording apparatus includes: a plurality of recording heads each of which includes an ejection surface; a head frame; at least one annular protrusion; a support tray; and a moving device. One or more positioning pins are provided in an inner area of the support tray that is enclosed with the annular protrusion, the positioning pins extending in a direction perpendicular to a flat surface which includes a contact portion of the annular protrusion that is come into contact with the head frame, and the head frame has one or more positioning holes into which the positioning pins are insertable in the contact state of the annular protrusion.

21 Claims, 8 Drawing Sheets

RECORDING APPARATUS

CROSS REFERENCE TO RELATED APPLICATION

The present application claims priority from Japanese Patent Application No. 2008-17144, which was filed on Jan. 29, 2008, the disclosure of which is herein incorporated by reference in its entirety.

BACKGROUND OF THE INVENTION

1. Field of the Invention

The present invention relates to a recording apparatus in which an image is recorded on a recording medium by ejecting droplets of a liquid.

2. Discussion of Related Art

As an inkjet printer which records an image on a recording medium such as a recording sheet by ejecting droplets of ink toward the recording medium, there is known an inkjet printer which includes an inkjet head that has an ink ejection surface to which a plurality of nozzles for ejecting droplets of ink to a recording medium open. In the inkjet head, the plurality of nozzles happen to perform a defective ejection (a defect in ejection) because of an intrusion of dusts of the recording sheet into the nozzles and/or an increase in viscosity of ink in the nozzles. In order to prevent the defective ejection, there is known such a technique that a cap fluid-tightly covers the ink ejection surface during a resting phase of the inkjet printer, for example, as disclosed in JP-A-2004-122423.

SUMMARY OF THE INVENTION

In the above-mentioned technique, one cap fluid-tightly covers a plurality of ink ejection surfaces. Thus, a structure of the cap can be simplified. However, since the cap is oversized, it is difficult to fluid-tightly cover the ink ejection surfaces with certainty in a state in which the cap is positioned accurately relative to the ink ejection surfaces.

In the above-described technical background, the present invention has been developed. It is therefore an object of the present invention to provide a recording apparatus in which the ejection surface can be fluid-tightly covered with certainty.

According to the present invention, there is provided a recording apparatus comprising: a plurality of recording heads each of which includes an ejection surface to which a plurality of nozzles open; a head frame which has a plurality of through holes at arrangement positions where the plurality of recording heads are arranged and which supports the plurality of recording heads in a state in which the respective ejection surfaces of the recording heads are exposed through the respective through holes; at least one annular protrusion which encloses at least one of the ejection surfaces of the plurality of recording heads that is exposed through the head frame in a state in which the at least one annular protrusion is held in contact with the head frame; a support tray which supports the at least one annular protrusion and cooperates with the at least one annular protrusion to cover the at least one of the plurality of ejection surfaces; and a moving device which moves at least one of the head frame and the support tray such that the head frame and the annular protrusion are selectively positioned in either one of a spaced state in which the head frame and the annular protrusion are spaced from each other, and a contact state in which the head frame and the annular protrusion are held in contact with each other. One or more positioning pins are provided in an inner area of the support tray that is enclosed with the annular protrusion, and the positioning pins extend in a direction perpendicular to a flat surface which includes a contact portion of the annular protrusion that is come into contact with the head frame. The head frame has one or more positioning holes into which the positioning pins are insertable in the contact state of the annular protrusion.

In the recording apparatus in accordance with the present invention, at least one of the respective ejection surfaces of the plurality of recording heads can be enclosed with the at least one annular protrusion that is positioned relative to the head frame by the one or more positioning pins, so that the at least one of the ejection surfaces can be fluid-tightly covered with certainty. Further, since the one or more positioning pins are provided in the inner area of the support tray, the recording apparatus can be downsized.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF THE PREFERRED EMBODIMENTS

Figure 1:
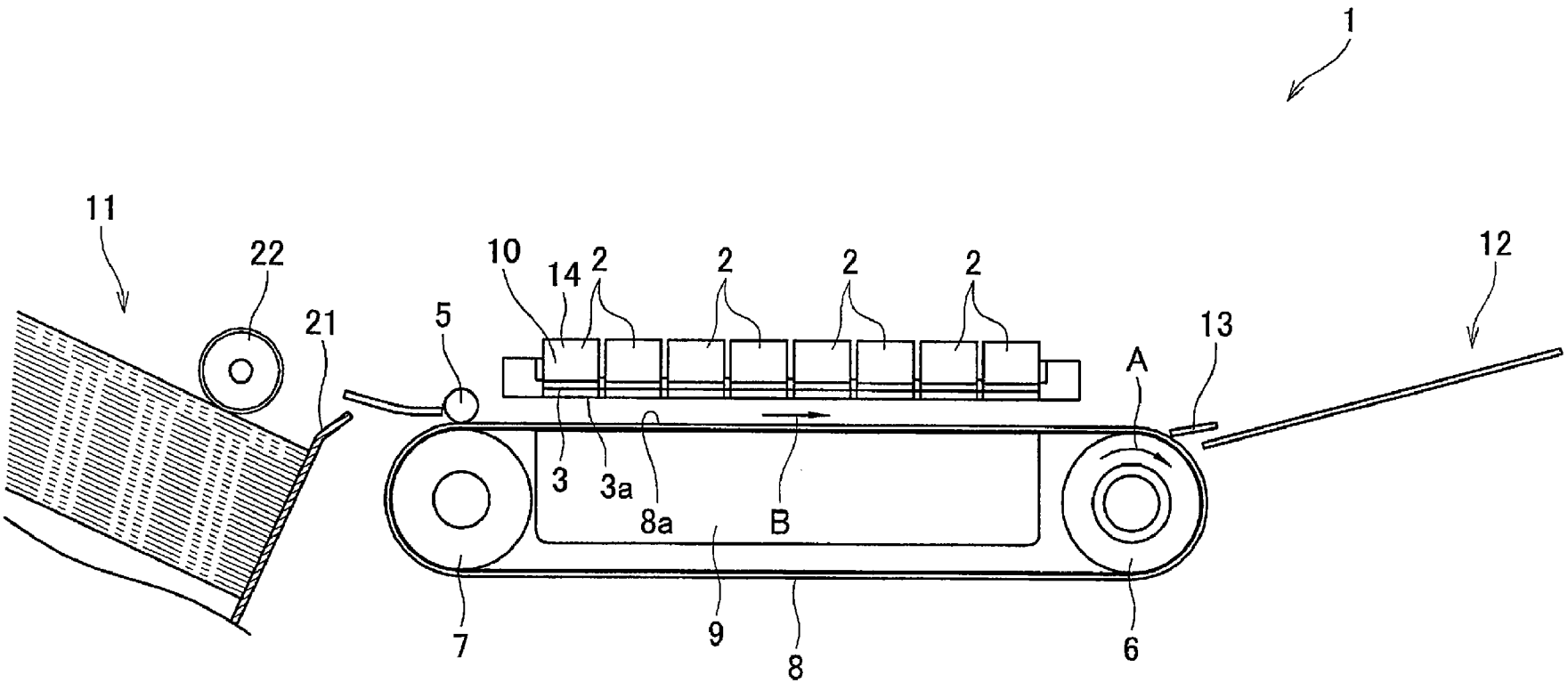
FIG. 1 is a side cross-sectional view schematically showing an inkjet printer as one embodiment to which the present invention is applied.

Hereinafter, there will be described preferred embodiments of the present invention with reference to the drawings. FIG. 1 shows an appearance of an inkjet printer 1 as one embodiment of the present invention. As shown in FIG. 1, the inkjet printer 1 is a color inkjet printer which includes eight inkjet heads or printheads 2 as a plurality of recording heads. In the inkjet printer 1, there are provided a sheet-feed device 11 on a left-hand side of FIG. 1 and a sheet-discharge portion 12 on a right-hand side of FIG. 1.

In the inkjet printer 1, there is formed a sheet-feed path for feeding a recording sheet as a recording medium from the sheet-feed device 11 to the sheet-discharge portion 12. The sheet-feed device 11 includes a pick-up roller 22 which feeds an uppermost one of a plurality of recording sheets that are accommodated in a sheet-feed tray 21. The recording sheet is fed from the left-hand side of FIG. 1 toward the right-hand side thereof along the sheet-feed path. In a middle portion of the sheet-feed path, there are disposed a pair of belt rollers 6, 7 and an endless feed belt 8 which is wound on the belt rollers 6, 7. Silicone treatment is performed to an outer circumferential surface or a feed surface 8*a* of the feed belt 8 such that the feed surface 8*a* has an adhesion. A press roller 5 is disposed on a downstream side of the sheet-feed device 11 in a sheet-feed direction as a medium feed direction and presses the recording sheet that is fed from the sheet-feed device 11 against the feed surface 8*a* of the feed belt 8. Thus, the recording sheet that is pressed against the feed surface 8*a* is supported by an adhesive force of the feed surface 8*a* and is fed toward the downstream side in the sheet-feed direction. At this time, the belt roller 6 that is located on the downstream side in the sheet-feed direction is rotated in a clockwise direction in FIG. 1 or in a direction indicated by an arrow A by a drive force from a drive motor (not shown).

An area that is opposed to the inkjet head 2 in the middle portion of the sheet-feed path forms an image recording area in which an image is recorded on the recording sheet. Furthermore, on the downstream side of the feed belt 8 along the sheet-feed path, there is provided a sheet-separate plate 13. The sheet-separate plate 13 is for separating the recording sheet that is supported by and stuck to the feed surface 8*a* of the feed belt 8 from the same 8*a*, and for feeding the separated recording sheet rightward in FIG. 1 or toward the sheet-discharge portion 12 in the sheet-feed direction.

Within an area that is enclosed or defined by the feed belt 8, there is disposed a platen 9 which has a substantially rectangular parallelepiped shape and supports the feed belt 8 such that the platen 9 is held in contact with an inner circumferential surface of the feed belt 8.

Figure 2:
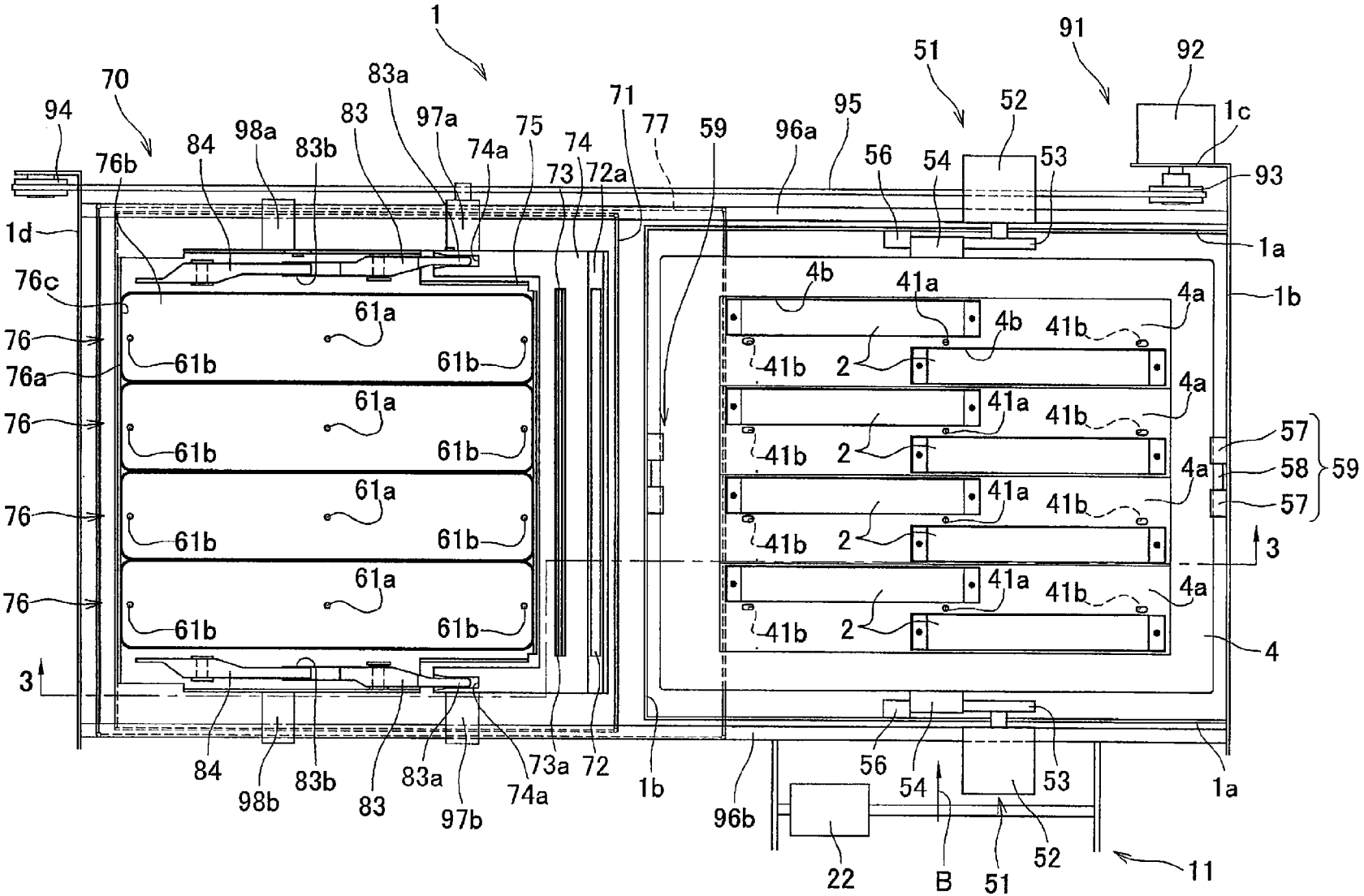
FIG. 2 is a plan view schematically showing a pertinent structure of the inkjet printer in FIG. 1.

The eight inkjet heads 2 are arranged in a staggered or a zigzag manner along the sheet-feed direction B, i.e., a direction extending upward in FIG. 2. Respective two inkjet heads 2 that are arranged in order from an upstream side in the sheet-feed direction B form a set of the inkjet heads 2. In other words, four sets of the inkjet heads 2 are arranged in the sheet-feed direction B. The four sets of inkjet heads 2 correspond to four colors of inks that differ from each other, i.e., magenta, yellow, cyan, and black inks. Each of the inkjet heads 2 ejects droplets of corresponding one of the four colors of inks. The two inkjet heads 2 that form the set of the inkjet heads 2 are arranged so as to be adjacent to each other at a part thereof and be overlapped with each other with respect to the sheet-feed direction B.

Figure 3:
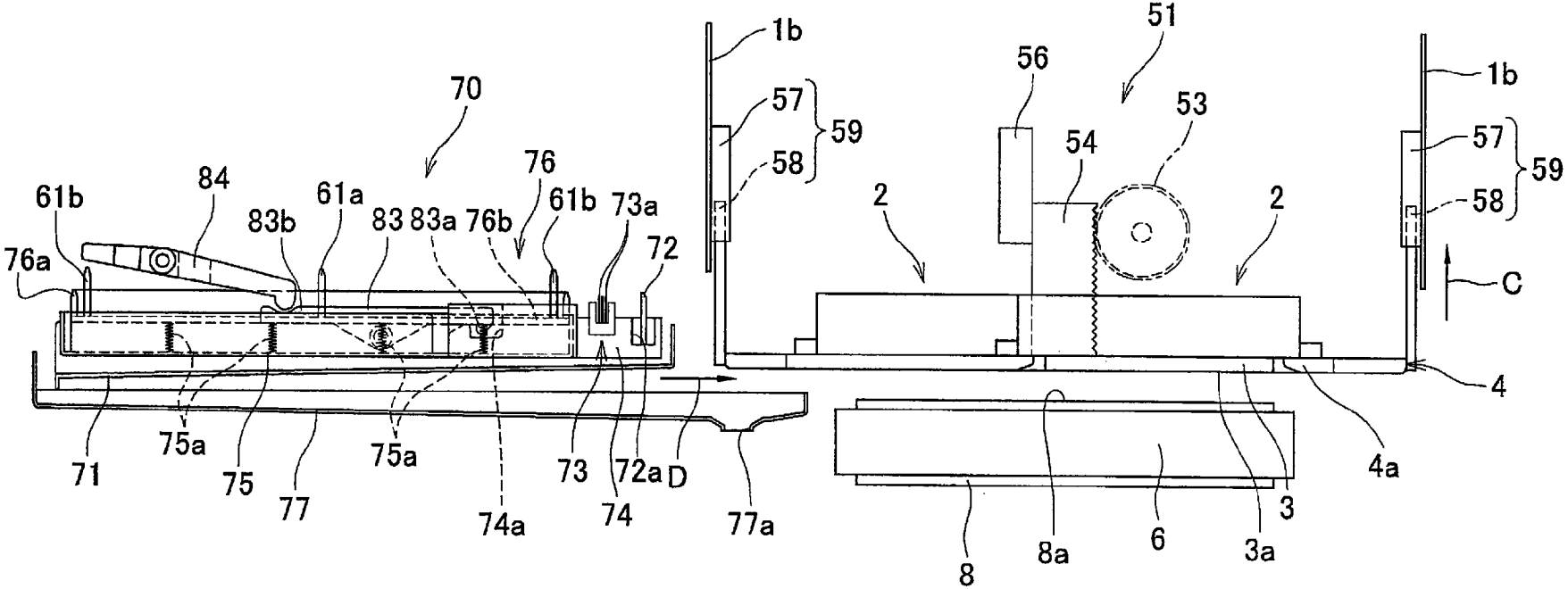
FIG. 3 is a cross-sectional view taken along line 3-3 in FIG. 2.

In the present embodiment, the inkjet printer 1 is a line-type printer. As shown in FIG. 2, each of the inkjet heads 2 has a generally rectangular parallelepiped shape extending in the direction perpendicular to the sheet-feed direction B or in the main scanning direction. Further, as shown in FIGS. 1 and 3, each of the inkjet heads 2 includes a head body 3 in a lower end thereof. The head body 3 has a laminar structure in which a passage unit that has an ink passage including a pressure chamber and an actuator that applies a pressure on ink in the pressure chamber are stacked on, and adhered to, each other.

Figure 4:
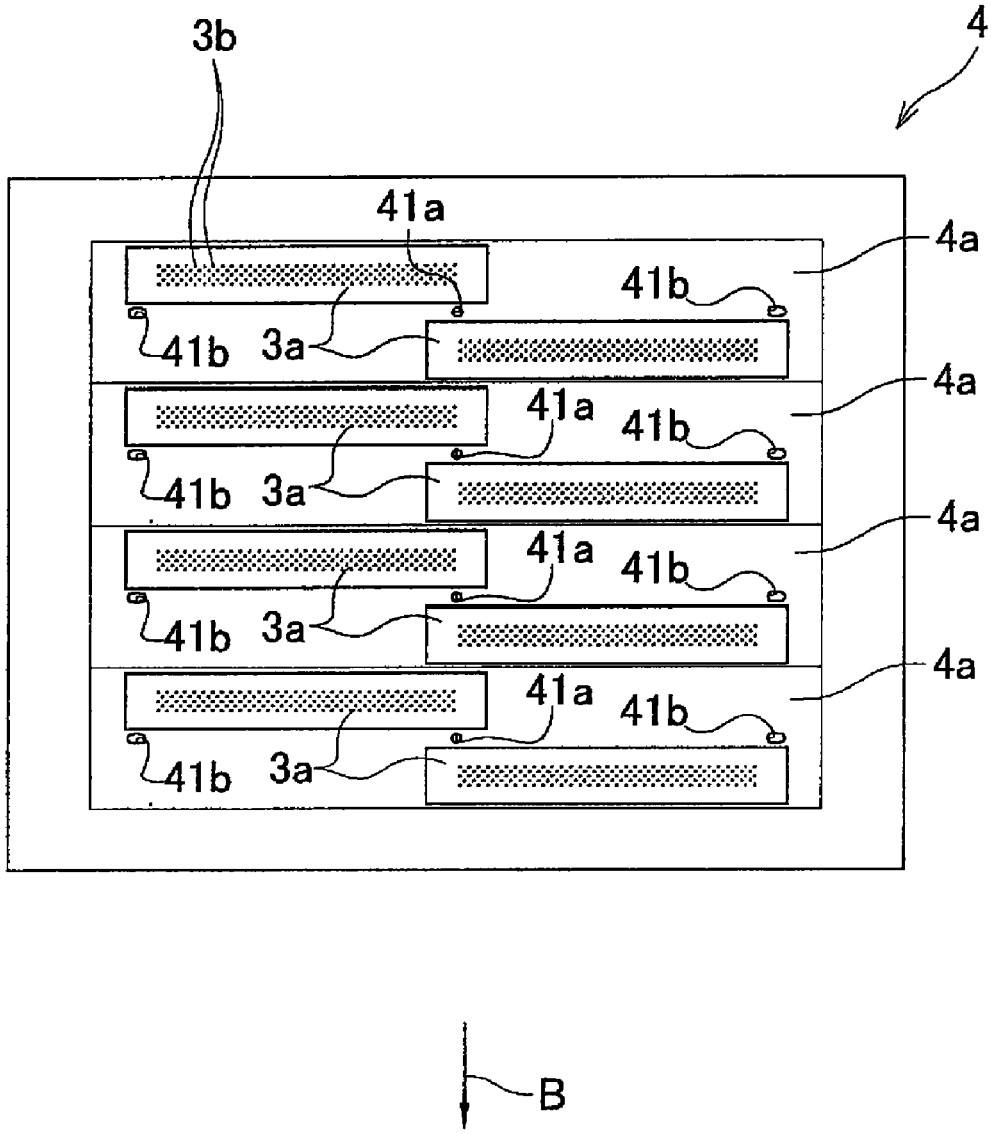
FIG. 4 is a bottom view of eight inkjet heads of the inkjet printer in FIG. 2 as seen in a direction from downward.

On an upper surface of the head body 3, a reservoir unit 10 that is partly covered by a cover 14 is fixed for temporarily accommodating ink. Inside of the reservoir unit 10, there is formed an ink reservoir for accommodating ink supplied from an ink tank, not shown. The ink accommodated in the ink reservoir of the reservoir unit 10 is supplied to the ink passage (not shown) of the head body 3. As shown in FIG. 4, a multiplicity of openings of the nozzles (or ejection openings) 3*b* each of which has a tiny diameter are arranged in a bottom surface of the head body 3 and are in communication with the ink passage. The bottom surface of the head body 3 forms an ink ejection surface 3*a* as an ejection surface that is opposed to the feed surface 8*a*. A surface of the ink ejection surface 3*a* is coated with a water-repellent film or layer, not shown. The water-repellent film prevents waste ink from being stuck to a circumference of the openings of the nozzles 3*b*.

The head body 3 is located in such a manner that the ink ejection surface 3*a* and the feed surface 8*a* of the feed belt 8 are in parallel with each other and a small clearance is made between the ink ejection surface 3*a* and the feed surface 8*a*. A space having the clearance forms a part of the sheet-feed path. In the present embodiment, when the recording sheets that are fed on the feed belt 8 respectively pass through the space right below the head body 3, the respective colors of inks are ejected through the respective nozzles 3*b* toward an upper surface or a recording (printing) surface of the recording sheet, so that a desired color image is recorded (printed) on the recording sheet.

As shown in FIGS. 2 and 4, four head frames 4*a* are arranged in the sheet-feed direction B and fixed to the frame 4. Each of the four head frames 4*a* is a rectangular-shaped plate member and supports the corresponding set of the two inkjet heads 2. Each of the head frames 4*a* has two holes 4*b* at respective arrangement positions where the two recording heads 2 are arranged. Each of the two holes 4*b* has a rectangular shape extending in the main scanning direction. The respective two holes 4*b* are arranged so as to be overlapped with each other at a part thereof with respect to the sheet-feed direction B and be adjacent to each other in the main scanning direction. Each of the head frames 4*a* supports the corresponding set of the inkjet heads 2 in a state in which each of the ink ejection surfaces 3*a* is exposed through a lower opening of each of the holes 4*b*. In the present embodiment, the respective ink ejection surfaces 3*a* of the inkjet heads 2, a lower surface of the head frame 4*a* and a lower surface of the frame 4 are located on the same plane with each other. Therefore, a clearance between the respective ink ejection surfaces 3*a* of the corresponding inkjet heads 2 is closed by each of the head frames 4*a*.

Another embodiment may be adopted, in which a set of the inkjet heads 2 are formed such that the two inkjet heads 2 are supported by the head frame 4*a* with a predetermined positional relation, similar to the present embodiment, and in which, when the set of inkjet heads 2 are attached to the frame 4, the respective ink ejection surfaces 3*a* of the inkjet heads 2 and the respective lower surfaces of the head frame 4*a* and the frame 4 are not located on the same plane. In this embodiment, it is important that a fluid-tightly closed space is formed by the set of inkjet heads 2 and a cap 76 described later. For example, a plate member (a filler plate) may be provided for filling a clearance or a level deference (a step) produced between the inkjet heads 2 and the frame 4 and may be located at a position where the filler plate and the cap are contactable with each other. The filler plate may be formed integrally with the frame 4, or may be fixed to a side of the set of recording heads 2.

In the head frame 4*a*, there are formed one main positioning hole 41*a* and two sub positioning holes 41*b* into which one main positioning pin 61*a* and two sub positioning pins 61*b* are respectively insertable for positioning the cap 76 relative to the head frame 4*a* during a capping operation mentioned later. The main positioning hole 41*a* is a through hole which has a circular-shaped opening in a center of the head frame 4*a* that corresponds to a midpoint of line segment by which respective centers of the two ejection surfaces 3*a* of the set of recording heads 2 are connected with each other. As shown in FIG. 5, an O-ring 41*c* as a sealing member is disposed in an inner side surface of the main positioning hole 41*a*. When the main positioning pin 61*a* is inserted into the main positioning hole 41*a*, an inner circumferential surface of the O-ring 41*c* and an outer circumferential surface of the main positioning pin 61*a* are come into contact with each other, i.e., the O-ring 41*c* functions to seal a clearance between the main positioning pin 61*a* and the main positioning hole 41*a*. Thus, the main positioning hole 41*a* is fluid-tightly closed.

The two sub positioning holes 41*b* are formed in respective positions that are in the vicinity of opposite ends of the head frame 4*a* in the main scanning direction and in a middle of the head frame 4*a* in the sheet-feed direction B, and are adjacent to the ink ejection surface 3*a*. Each of the sub positioning holes 41*b* is an elongate hole extending in a direction away from the center (or the main positioning hole 41*a*) of the head frame 4*a* or in the main scanning direction and forms a closed hole or a dead-end hole in a state in which an upper end portion thereof is closed, as shown in FIG. 5. The main positioning hole 41*a* and the sub positioning holes 41*b* are located on a line parallel to or extending in the main scanning direction and passing through the center of the head frame 4*a*. The two sub positioning holes 41*b* are point-symmetric with each other with respect to the center of the head frame 4*a*.

As shown in FIGS. 2 and 3, the frame 4 is supported so as to be movable in a vertical direction or an up and down direction by a frame moving device 51 as a moving device that is disposed in the inkjet printer 1. In the present embodiment, as shown in FIG. 2, a pair of the frame moving devices 51 are disposed in opposite sides of the inkjet printer 1 outside of the eight inkjet heads 2 in the sheet-feed direction B or in an upper side and a lower side of the inkjet printer 1 in FIG. 2. Each of the frame moving device 51 includes: a drive motor 52 as a drive source for moving the frame 4 in the vertical direction; a pinion 53 which is fixed to an (output) axis of the drive motor 52; a rack 54 which is provided in the frame 4 so as to be meshed with the pinion 53; and a guide 56 which is located in a position where the rack 54 is located between the guide 56 and the pinion 53.

The two drive motors 52 of the two frame moving devices 51 are respectively fixed to a pair of main body frames 1*a* of the inkjet printer 1 that are located to be opposed to each other with respect to the sheet-feed direction. Each of the two racks 54 extends in the vertical direction and is attached to a side surface of the frame 4 at a lower end portion thereof. Further, one of opposite side surfaces of each of the racks 54 that is opposite to the pinion 53 is held in contact with the guide 56 to be slidable on the guide 56. The guide 56 is fixed to the main body frame 1*a*.

In the present embodiment, when the two drive motors 52 are synchronized to be driven and rotated such that the two pinions 53 are rotated in a normal (forward) or a reverse direction, the two racks 54 are moved in the vertical direction or the up and down direction. By the vertical movement of the two racks 54, the frame 4, the head frame 4*a* and the eight inkjet heads 2 are moved in the vertical direction.

A pair of guide portions 59 are disposed on opposite sides in a lengthwise direction of the inkjet head 2. Each of the guide portions 59 consists of a rod member 58 and a pair of guides 57 that are located such that the rod member 58 is placed therebetween. As shown in FIG. 3, the pair of guides 57 extend in the vertical direction and are respectively fixed to respective side surfaces of a pair of main body frames 1*b* that are opposed to each other with respect to the direction perpendicular to the sheet-feed direction B. The rod member 58 extends in the vertical direction, similar to the guides 57, and fixed to opposite side surfaces of the frame 4 that are located to be opposed to the main body frames 1*b* and in parallel with the same 1*b*. Further, the rod member 58 are located between the two guides 57 so as to be slidable thereon. Due to the guide portions 59, when the frame 4 is moved in the vertical direction by the frame moving device 51, it is prevented that the ink ejection surfaces 3*a* of the inkjet heads 2 are inclined relative to the feed surface 8*a*.

The frame 4 is normally positioned in a recording (printing) position or a position shown in FIG. 3 where the eight inkjet heads can eject droplets of inks toward the recording sheets. Only when the maintenance operations to the inkjet heads 2 are performed, the frame 4 and the eight inkjet heads 2 are moved by the frame moving device 51 to be positioned in a head maintenance position that is located above the recording position or in an upper side of the recording position.

Hereinafter, a maintenance unit 70 for performing maintenance operations with respect to the inkjet heads 2 will be described. As shown in FIGS. 2 and 3, in the inkjet printer 1, the maintenance unit 70 for performing the maintenance operations to the head main body 3 is provided on a left-hand side of the inkjet heads 2 or a retracted position. As shown in FIG. 3, the maintenance unit 3 includes two trays 71, 75 that are movable horizontally. As shown in FIGS. 2 and 3, the tray 71 has a generally square-shaped and box-like structure with an opening that opens upward and can hold the tray 75 inside thereof. The tray 71 and the tray 75 are detachably engageable with each other by an engaging device mentioned later. The tray 71 and the tray 75 are attached to or detached from each other depending on the maintenance operations.

As shown in FIG. 3, one of opposite side surfaces of the tray 71 that is opposite to the inkjet heads 2 is opened, so that when the trays 71, 75 are detached from each other on an occasion, e.g., during a purging operation, only the tray 71 is movable while the tray 75 is left in the retracted position. Despite the engaging device is in a engaging state or not, when the maintenance unit 70 is horizontally moved as mentioned later, the frame 4 is in advance moved upward or in a direction indicated by an arrow C in FIG. 3 to the head maintenance position such that a space for the maintenance unit 70 is held between the eight ink ejection surfaces 3*a* and the feed surface 8*a*. Then, the maintenance unit 70 is horizontally moved in a direction indicated by an arrow D in FIG. 3.

Furthermore, a waste-ink tray 77 is disposed right below the maintenance unit 70, i.e., right under the retracted position of the maintenance unit 70. The waste-ink tray 77 has a size that can hold the tray 71 inside thereof in its plan view and has such a structure that, even when the tray 71 is moved to a right-hand end in FIG. 2, one of edge portions of the tray 71 in the direction perpendicular to the sheet-feed direction B that is opposite to the inkjet heads 2 is located above the waste-ink tray 77. In one of opposite end portions of the waste-ink tray 77 that is opposite to the inkjet heads 2, an ink-discharge hole 77*a* is formed to penetrate through the waste-ink tray 77 in the vertical direction. By the ink-discharge hole 77*a*, inks that are received by the waste-ink tray 77 from the tray 71 flow into a waste-ink reservoir, not shown.

In the tray 71, there are disposed a wiper 72, an ink receiving member 73 and the tray 75 in order from a side nearer to the inkjet heads 2. As shown in FIG. 2, the four caps 76 are disposed in the tray 75. Each of the caps 76 includes: an annular protrusion 76*a*; a rectangular-shaped bottom plate portion 76*b* that supports the annular protrusion 76*a* from below (the bottom); and the one main positioning pin 61*a* and the two sub positioning pins 61*b* that are located in an inner area of the annular protrusion 76*a* that is enclosed with the annular protrusion 76*a*. The main positioning pin 61*a* and the sub positioning pins 61*b* are respectively set up on the bottom plate portion 76. The four caps 76 are arranged in respective positions corresponding to the respective head frames 4*a* in the sheet-feed direction B.

Figure 6:
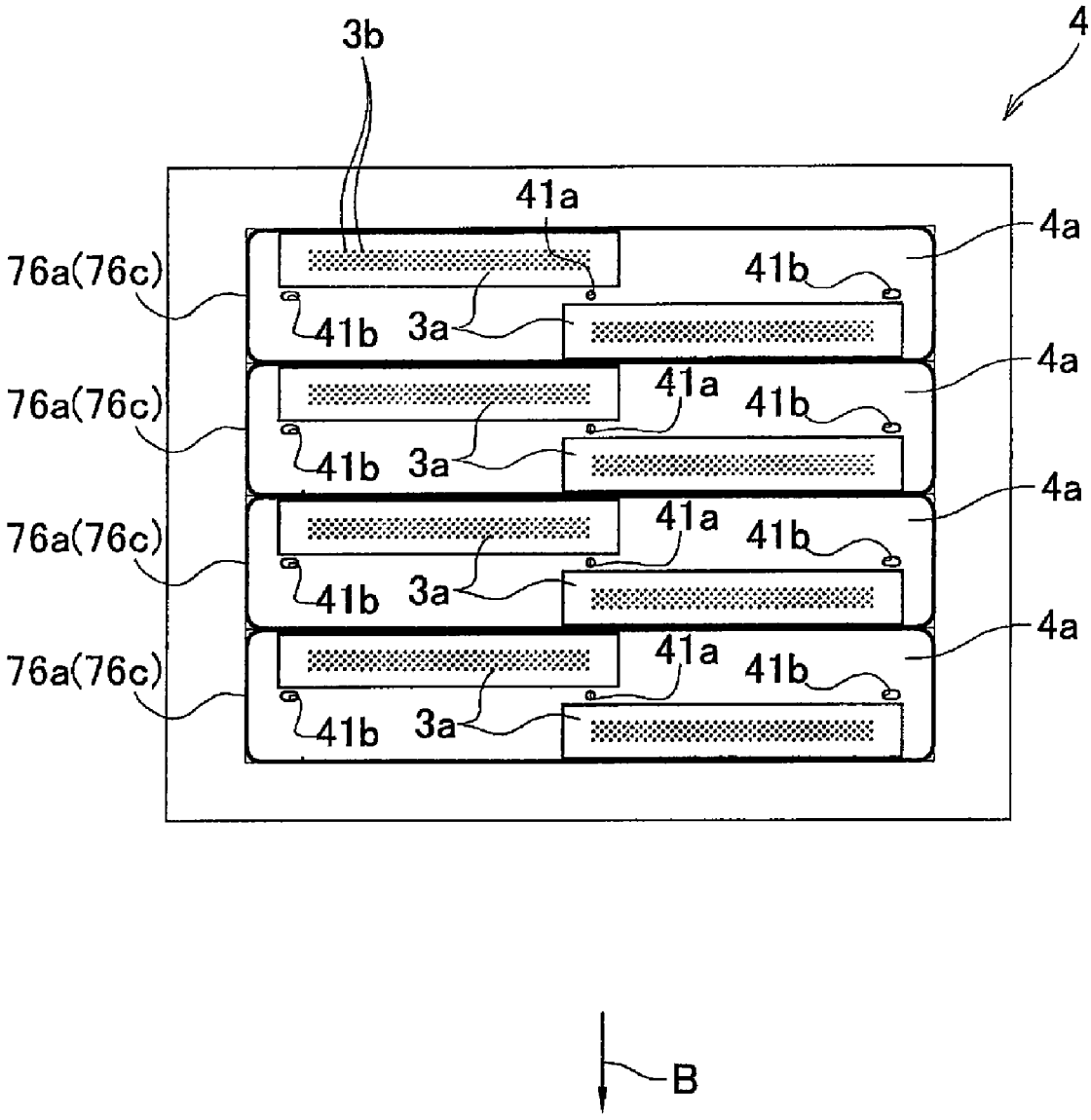
FIG. 6 is a plan view showing a positional relation between the inkjet heads and the annular protrusions when the annular protrusions and the head frame are held in contact with each other.

The annular protrusion 76*a* extends upward on an outer circumferential portion of the bottom plate portion 76*b*. Thus, the annular protrusion 76*a* and the bottom plate portion 76*b* are formed integrally with each other so as to define a recessed portion 76*c* that opens upward. The recessed portion 76*c* has a shape in its plan view so as to enclose the two ink ejection surfaces 3*a* corresponding to the one set of the inkjet heads 2. Further, the annular protrusion 76*a* is contactable with only an outer circumferential edge portion of the corresponding head frame 4*a* by the capping operation mentioned later. When the annular protrusion 76*a* is come into contact with the corresponding head frame 4*a*, the two ejection surfaces 3*a* corresponding to the one set of the inkjet heads 2 which the head frame 4*a* supports are covered by the one recessed portion 76, as shown in FIG. 6. The cap 76 can cover the two ink ejection surfaces 3*a*, so that inks in the nozzles 3*b* are prevented from becoming dry. Further, the annular protrusion 76*a* is formed of an elastic material such as a rubber. Therefore, the head frame 4*a* and the annular protrusion 76*a* can be easily stuck firmly to each other, a fluid-tightness of the recessed portion 76*c* can be maintained when the head frame 4 and the annular protrusion 76*a* are come into contact with each other.

Each of the one main positioning pin 61*a* and the two sub positioning pins 61*b* has a cylindrical shape extending upward on the bottom plate portion 76*b*, or in a direction perpendicular to a flat surface including a contact portion of the annular protrusion 76*a* that is come into contact with the head frame 4*a*. Each of the one main positioning pin 61*a* and the two sub positioning pins 61*b* has a tapered distal end. The main positioning pin 61*a* is located in a center of the inner area of the annular protrusion 76*a*. The sub positioning pins 61*b* are respectively located in the vicinity of opposite ends of the inner area of the annular protrusion 76*a* in the main scanning direction or in an extending direction in which the inner area extends and located in a middle of the inner area in the sheet-feed direction B.

As mentioned above, the main positioning pin 61*a* and the two sub positioning pins 61*b* are located on a line that passes through the center of the inner area of the annular protrusion 76*a* and extends parallel to the main scanning direction. Further, the two sub positioning pins 61*b* are located in respective positions that are point-symmetric with respect to the center of the inner area. Therefore, when the annular protrusion 76*a* is come into contact with the head frame 4*a*, a press force from the annular protrusion 76*a* is equally applied to respective contact portions of the annular protrusion 76*a* and the head frame 4*a*, leading to forming a fluid-tightly closed area during the capping operation with certainty even if the press force is decreased.

Respective distal ends of the main positioning pin 61*a* and the sub positioning pins 61*b* are located in positions more remote from the bottom plate portion 76*b* than a distal end of the annular protrusion 76*a*. In the capping operation mentioned later, the main positioning pin 61*a* is inserted into the main positioning hole 41*a*, while the two sub positioning pins 61*b* are respectively inserted into the two positioning holes 41*b*. Accordingly, in a state in which the annular protrusion 76*a* is always maintained at a predetermined positional relation with the ink ejection surfaces 3*a*, the cap 76 can be positioned relative to the head frame 4*a* and the inkjet heads 2.

In the present embodiment, the cap 76 is formed by a plurality of times of molding or by insert molding in which the annular protrusion 76*a* is formed of an elastic material, and in which the bottom plate portion 76*b* and the main positioning pin 61*a* and the sub positioning pins 61*b* are formed integrally with each other of a hard (rigid) resin material.

Figure 5A:
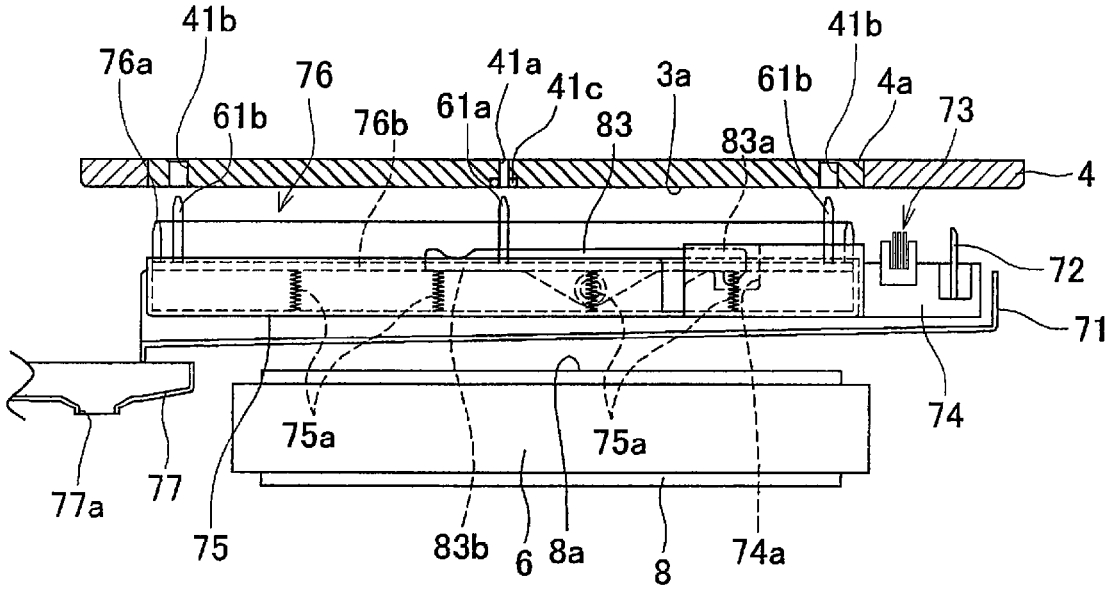
FIG. 5A is an illustrative view showing a state in which a maintenance unit shown in FIG. 2 is moved to a maintenance position.
Figure 5B:
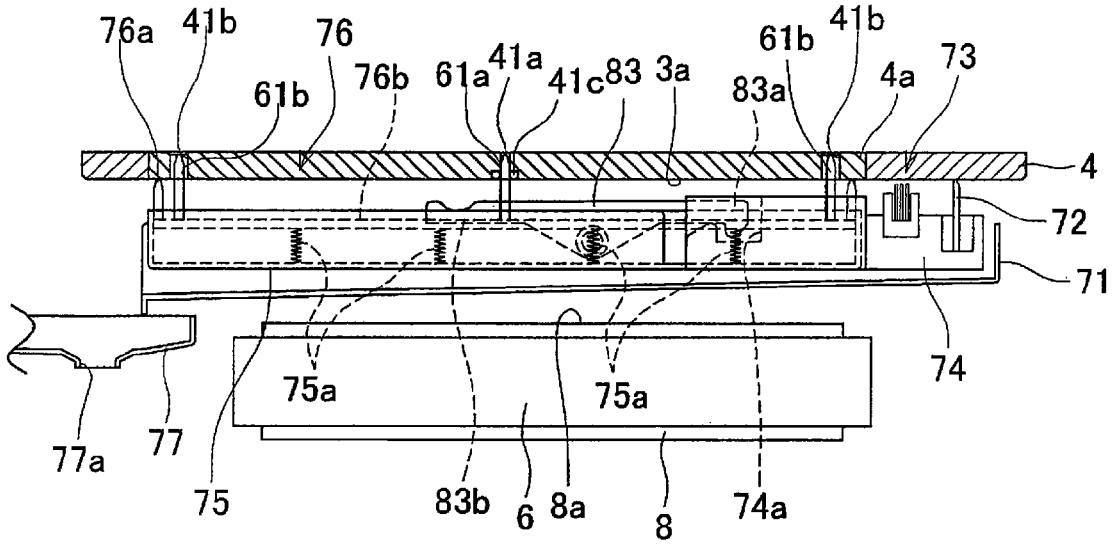
FIG. 5B is an illustrative view showing a state in which an annular protrusion of a cap shown in FIG. 2 and a head frame are held in contact with each other.

By springs 75*a* shown in FIG. 5B, the cap 76 is supported on a bottom surface of the tray 75 and biased upward. There are also clearances made between opposite side surfaces of the cap 76 in the main scanning direction and opposite inner wall surfaces of the tray 75 that are opposed to the side surfaces of the cap 76. Accordingly, when the annular protrusion 76*a* of the cap 76 and the head frame 4*a* are come into contact with each other, an impact force by the contact of the protrusion 76*a* and the head frame 4*a* diminishes because of the springs 75*a*. Further, even when a degree of parallelism of the cap 76 relative to head frame 4*a* has some error, the cap 76 can follow the head frame 4*a*. Therefore, the fluid-tightly closed spaces can be formed inside of the respective recessed portions 76*c*.

As shown in FIG. 2, a retaining member 74 that retains the wiper 72 and the ink receiving member 73 is fixed to one of opposite ends of the tray 71 that is close to the recording heads 2. As shown in FIG. 2, the retaining member 74 has a U-shape in its plan view, and the wiper 72 and the ink receiving member 73 are retained on a bottom portion of the U-shaped retaining member 74 that extends in the sheet-feed direction. On the other hand, a pair of arm portions of the U-shaped retaining member 74 that extend in the direction perpendicular to the sheet-feed direction B have respective recessed portions 74*a* as the engaging device.

As shown in FIGS. 2 and 3, the ink receiving member 73 includes a plurality of thin plates 73*a* each of which has a length in the sheet-feed direction B that is a little longer than a whole length of the eight inkjet heads 2 that are arranged in the sheet-feed direction B. The plurality of thin plates 73*a* are arranged parallel to each other by a distance suitable for a capillary force of inks. The ink receiving member 73 is also arranged to always have a clearance, e.g., a clearance of 0.5 mm, between the ink receiving member 73 and the ink ejection surface 3*a* in a state in which the wiper 72 is held in contact with the ink ejection surface 3*a*. Each of the thin plates 73*a* is made of a stainless steel.

Similar to the plurality of thin plates 73*a*, the wiper 72 has a length that extends in the sheet-feed direction B and that is a little longer than a whole length of the eight inkjet heads 2 that are arranged in the sheet-feed direction B. As shown in FIG. 2, the retaining member 74 has a groove 72*a* that extends between opposite ends of the retaining member 74 in the sheet-feed direction B, and the wiper 72 is fixed to a bottom surface portion of the groove 72*a*. Inks that are wiped off by the wiper 72 are dropped off from the groove 72*a* to the waste-ink tray 77 via the tray 71. The wiper 72 is made of an elastic material such as a rubber.

The tray 71 and the tray 75 are detachably (removably) engaged with each other by the engaging devices, as mentioned before. As shown in FIG. 2, the engaging devices are disposed in the vicinity of respective upper and lower sides of the tray 71, 75 in FIG. 2. Each of the engaging devices mainly consists of the recessed portions 74*a* that are respectively formed in the pair of arm portions of the retaining member 74 of the tray 71, and a pair of engaging members 83 that are supported by the tray 75 so as to be pivotable. Each of the engaging members 83 extends in the direction perpendicular to the sheet-feed direction B or in the main scanning direction and is pivotably supported by the tray 75 at a middle of the engaging member 83. In one of opposite end portions of each of the engaging members 83 that is closer to the inkjet heads 2, there is formed an engaging portion 83*a* that is engageable with the recessed portion 74*a*. Above the maintenance unit 70, a pair of contacting members 84, each of which is contactable with the other end portion 83*b* of each of the engaging members 83 that is most remote from the inkjet heads 2, are supported so as to be pivotable. When the contacting member 84 is pivoted so as to come into contact with the other end portion 83*b*, the engaging portion 83 and the recessed portion 74*a* are disengaged from each other. On the other hand, when the contacting member 84 is moved away from an end portion 84, the engaging member 83*a* and the recessed portion 74*a* are engaged with each other and returned to a state shown in FIG. 3.

As shown in FIG. 3, when maintenance operations mentioned later are not performed, the maintenance unit 70 stands still in the retracted position, or in a left-hand side position where the maintenance unit 70 is not opposed to the inkjet heads 2 in FIG. 2. When the maintenance operations are performed, the maintenance unit 70 is horizontally moved from the retracted position to a maintenance position where the maintenance unit 70 is opposed to the inkjet heads 2. At this time, the inkjet heads 2 are positioned in the head maintenance position, so that respective ends of the wiper 72 and the annular protrusion 76 are free from being come into contact with the ink ejection surface 3*a*.

When the ink ejection surface 3*a* is covered by the cap 76, the tray 71 and the tray 75 are engaged with each other by the engaging device and are integrally moved to the maintenance position. As shown in FIG. 2, the trays 71, 75 are supported by a pair of guide shafts 96*a*, 96*b* that extend in the direction perpendicular to the sheet-feed direction B (in the main scanning direction) so as to be movable. The tray 71 has two bearing members 97*a*, 97*b* that protrude from opposite side surfaces of the retaining member 74 in the vertical direction in FIG. 2 or in the sheet-feed direction B. The tray 75 has two bearing members 98*a*, 98*b* that protrude from opposite side surfaces of the tray 75 in the vertical direction in FIG. 2 or in the sheet-feed direction B. The pair of guide shafts 96*a*, 96*b* are respectively fixed to the main body frames 1*b*, 1*d* at respective opposite ends thereof in the main scanning direction and are provided parallel to each other between the main body frame 1*b*, 1*d*. In the present embodiment, the pair of guide shafts 96*a*, 96*b* are fixed to the main body frames 1*b*, 1*d* by screws. In the above-mentioned construction, each of the trays 71, 75 are movable along the guide shafts 96*a*, 96*b* in a left and right direction in FIG. 2 (in a direction indicated by an arrow D in FIG. 3) or in the main scanning direction.

Hereinafter, a horizontal movement device 91 for horizontally moving the trays 71, 75 will be described. As shown in FIG. 2, the horizontal movement device 91 includes a motor 92, a motor pulley 93, an idle pulley 94, a timing belt 95 and the guide shafts 96*a*, 96*b*. The motor 92 is fixed by screws and the like to an attaching portion 1*c* that is disposed in one of opposite end portions of the main body frame 1*b* extending in the sheet-feed direction B. The motor pulley 93 is connected to the motor 92 so as to be rotated by a drive of the motor 92. The idle pulley 94 is rotatably supported by the main body frame 1*d* that is located on a most left-hand side in FIG. 2. The timing belt 95 is provided parallel to the guide shaft 96*a*, is disposed between the motor pulley 93 and the idle pulley 94 and is wound on the pulleys 93, 94. The timing belt 95 is connected to the bearing member 97*a* that is disposed in the retaining member 74.

In the above-mentioned horizontal movement device 91, when the motor 92 is driven, the timing belt 95 is driven or circulated by a rotation of the motor pulley 93 in a forward (normal) or a reverse direction. Because of the circulation of the timing belt 95, the tray 71 that is connected to the timing belt 95 via the bearing member 97*a* moves in the left and right direction in FIG. 2, i.e., in a direction toward the retracted position or the maintenance position. When the recessed portion 74*a* of the retaining member 74 and the engaging portion 83*a* are engaged with each other, the wiper 72 and the ink receiving member 73 in the tray 71 and the cap 76 in the tray 75 move together to the maintenance position or the retracted position. On the other hand, when the engaging portion 83*a* is disengaged from the recessed portion 74*a*, the wiper 72 and the ink receiving member 73 in the tray 71 moves to the maintenance position or the retracted position.

The maintenance operations performed by the maintenance unit 70 will be described with reference to FIGS. 5 through 7 as follows. The maintenance operations are performed by the maintenance unit 70 to the inkjet heads 2 mainly in order to improve and/or recover from a defect in ejection caused by foreign matters stuck to the nozzles 3*b* and/or an increased viscosity of ink in the vicinity of the nozzles 3*b*. In this case, a purging operation is performed in which a predetermined volume of ink is forcedly exhausted or purged. The maintenance operations are also performed in order to prevent such defect in ejection. In this case, a flushing operation is performed in which the predetermined number of ink droplets are ejected or flushed through the nozzles 3*b*. In the present embodiment, in the purging operation, the exhausted ink is received by the cap 76.

When the purging operation is performed for recovering of the inkjet heads 2 from the defect in ejection and so on, first, the frame 4 is moved upward by the frame moving devices 51. At this time, the two drive motors 52 are synchronized to be driven and rotated such that the two pinions 53 are rotated in the forward direction or in a clockwise direction in FIG. 3. By the rotation of the two pinions 53, the two racks 54 are moved upward. By the upward movement of the two racks 54, the frame 4 that is fixed to the two racks 54, the head frame 4*a* and the eight inkjet heads 2 are moved upward. Then, when the frame 4 and the inkjet heads 2 reach the maintenance position, a rotation of the drive motor 52 is stopped. Thus, a space for placement of the maintenance unit 70 is made between the ink ejection surfaces 3*a* and the feed belt 8. A flat lower surface including the ink ejection surfaces 3*a* of the inkjet heads 2 positioned in the head maintenance position is determined to be located in a position such that the flat lower surface is not come into contact with the distal ends of the wiper 72 and the annular protrusion 76*a* when the maintenance unit 70 is moved to the maintenance position.

Then, the capping operation for enclosing the ink ejection surfaces 3*a* by the cap 76 is performed. The capping operation is also performed in order to prevent drying of inks in the nozzles 3*b* during a resting phase in which recording (printing) has not been performed for a long time period. Next, as shown in FIG. 5A, the trays 71, 75 are moved to the maintenance position by the horizontal movement device 91 in a state in which the trays 71, 75 are engaged with each other by the engaging member 83. At this time, as shown in FIG. 6, the annular protrusion 76*a* of the cap 76 is positioned in a position so as to be opposed to a circumferential edge portion of the corresponding head frame 4*a*, and the recessed portion 76*c* of the cap 76 is opposed to the respective ink ejection surfaces 3*a* of the corresponding two inkjet heads 2 that forms the set of the inkjet heads 2. Further, the main positioning pin 61*a* and the two sub positioning pins 61*g* of the each cap 76 are respectively opposed to the main positioning hole 41*a* and the two sub positioning holes 41*b* of the corresponding head frame 4*a*.

Next, as shown in FIG. 5B, when the inkjet heads 2 (the frame 4) are moved downward by the frame moving device 51, the respective distal ends of the positioning pins 61*a*, 61*b* are inserted into the opposed positioning holes 41*a*, 41*b*. At this time, even when the cap 76 is expanded by heating, each of the sub positioning holes 41*b* is the elongated hole extending in a direction away from the main positioning hole 41*a* (the center of the head frame 4*a*), so that, even when the cap 76 is positioned relative to only the main positioning hole 41*a*, the sub positioning pins 61*b* are surely inserted into the sub positioning holes 41*b*. When the sub positioning pins 61*b* are inserted into the sub positioning holes 41*b*, the cap 76 is restrained from rotating about a center of the main positioning pin 61*a*. Therefore, the cap 76 can be positioned relative to the corresponding head frame 4*a* with high accuracy.

Then, when the inkjet heads 2 are moved down farther by the frame moving device 51, the end of the annular protrusion 76*a* is come into contact with the corresponding head frame 4*a* to be in a contact state. At this time, the respective ink ejection surfaces 3*a* of the two inkjet heads 2 that form the set of inkjet heads 2 are covered by the one recessed portion 76*c*. The capping operation is finished after the respective ink ejection surfaces 3*a* are thus fluid-tightly covered.

In a state in which the capping operation is finished, the purging operation is performed such that a pump (not shown) is operated to forcedly transmit ink in an ink tank (not shown) to the inkjet heads 2. By the operation of the pump, a predetermined volume of ink is purged through the nozzles 3*b* to an inner space of the recessed portion 76*c* of the cap 76. Due to the purging operation, such problems as the clogged nozzle 3*b* and increased viscosity of ink in the nozzle 3*b* that cause the defect in ejection can be solved. The ejected (purged) ink in the recessed portion 76*c* flows into the tray 71 via an exhaust passage, not shown, and then, moves to a left-hand side in FIGS. 5A, 5B along a bottom surface of the tray 71 and flows into the waste-ink tray 77. The purged ink is discharged from the ink-discharge hole 77*a* of the waste-ink tray 77. However, a part of the ejected ink is remained on the ink ejection surface 3*a* in the form of droplets of ink.

Figure 7A:
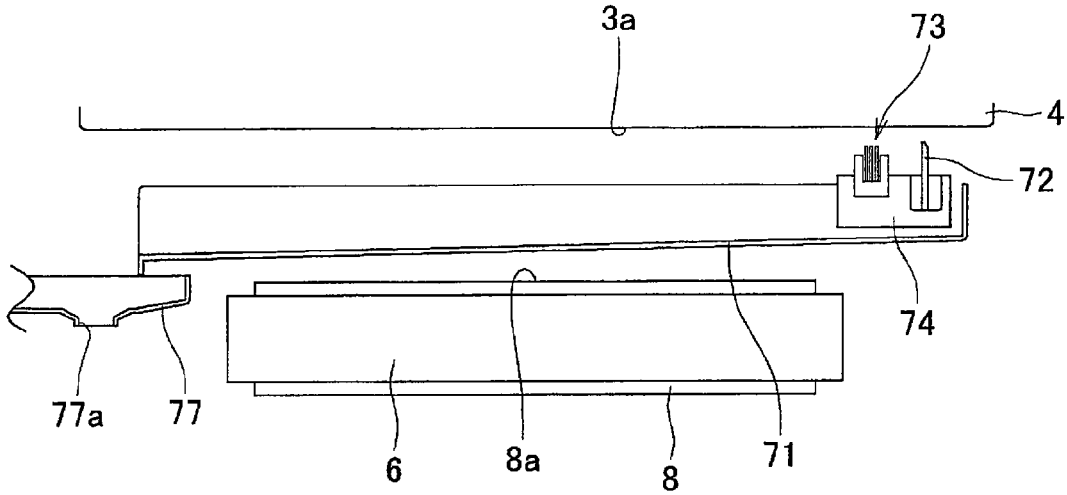
FIG. 7A is an illustrative view showing a state in which the inkjet head shown in FIG. 2 is moved from a recording position to a head maintenance position and a tray of the maintenance unit is moved to a maintenance position.

Next, a wiping operation is performed. The wiping operation is initiated after the following operation is performed. When the contacting member 84 is come into contact with the end portion 83*b* of the engaging member 83 and the engaging portion 83*a* is moved away from the recessed portion 74*a*, i.e., the recessed portion 74*a* and the engaging portion 83*a* are disengaged from each other, the tray 71 and the tray 75 are disconnected from each other, and then only the tray 71 is moved to the maintenance position, as shown in FIG. 7A.

Figure 7B:
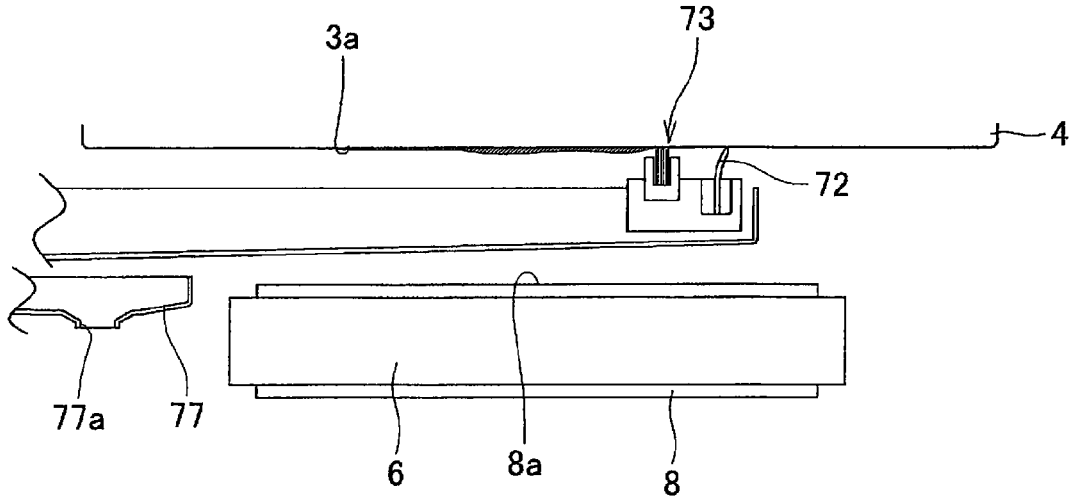
FIG. 7B is an illustrative view showing a state in which ink that is stuck on an ink ejection surface is wiped off by an ink receiving member and a wiper.

In the wiping operation, in a state in which the tray 71 is positioned in the maintenance position, the inkjet heads 2 are moved downward by the frame moving device 51. The inkjet heads 2 are positioned in such a position in the vertical direction in which the distal end of the wiper 72 is contactable with the ink ejection surface 3*a* when tray 71 is moved leftward, i.e., to the retracted position and in which a clearance, e.g., a clearance of 0.5 mm, is made between the respective upper ends of the thin plates 73*a* of the ink receiving member 73 and the ink ejection surface 3*a*. Then, as shown in FIG. 7B, the tray 71 is moved leftward by the horizontal movement device 91.

During the movement of the tray 71, droplets of ink stuck to the ink ejection surface 3*a* with a relatively large size are moved to spaces between the respective thin plates 73*a* of the ink receiving member 73 because of capillary action. At the same time, since the distal end or an upper end of the wiper 72 is located above the ink ejection surface 3*a*, the wiper 72 is held in contact with the ink ejection surface 3*a* in a state in which the wiper 72 is bent. Accordingly, the wiper 72 wipes off the remaining ink on ink ejection surface 3*a* that cannot be removed by the ink receiving member 73.

The maintenance operation is thus finished, in which the inkjet head 2 that has the defect in ejection is recovered by the purging operation and in which the remaining ink on the ink ejection surface 3*a* is wiped off by the wiping operation. As mentioned before, it is desirable that, after the maintenance operation is finished, the capping operation is performed again such that the ink ejection surface 3*a* is fluid-tightly covered by the cap 76. Therefore, drying of ink in the nozzles 3*b* can be prevented.

In the inkjet printer 1 in the present embodiment, the two ink ejection surfaces 3*a* with respect to the one set of inkjet heads 2 are covered by the cap 76 that is positioned relative to the frame by the positioning pins 61*a*, 61*b*, so that a structure for fluid-tightly closing the ink ejection surfaces 3*a* can be simplified and the ink ejection surfaces 3*a* can be fluid-tightly closed with certainty. Further, since the positioning pins 61*a*, 61*b* are disposed in the inner area of the annular protrusion 76*a*, the inkjet printer 1 can be miniatured.

In the inner space of the annular protrusion 76*a*, the two sub positioning pins 61*b* are respectively provided in the positions that are point-symmetric with respect to the center of the inner area, so that the annular protrusion 76*a* can be more precisely positioned relative to the frame 4.

Furthermore, since the main positioning pin 61*a* is provided in the center of the inner area of the annular protrusion 76*a*, even if shapes of the annular protrusion 76*a* and/or the bottom plate portion 76*b* are changed because of change in environment-temperature, the change in the shapes thereof is uniformed with respect to the center of the inner area of the annular protrusion 76*a*. Therefore, the ink ejection surfaces 3*a* can be fluid-tightly covered.

In addition, since each of the sub positioning holes 41*b* into which the sub positioning pins 61*b* are inserted is the elongate hole extending in the direction away from the main positioning hole 41*a*, even if locations of the sub positioning pins 61 are changed because of change in temperature environment, the sub positioning pins 61*b* can be inserted into the sub positioning holes 41*b* with certainty.

A length of the elongate hole (the sub positioning hole 41*b*) is determined depending on an amount of displacement of the sub positioning pin 61*b* with respect to the center of the inner area. In this case, the length of the sub positioning hole 41*b* can be shortened, compared to a case in which a different position is determined as a base position. The two sub positioning holes 41*b* are symmetrically provided with respect to the center of the inner area so as to be made with the same shape and size, so that manufacturing of the two sub positioning holes 41*b* can be simplified.

Because the sub positioning pins 61*b* are disposed in the vicinity of opposite ends in the extending direction in which the inner area of the annular protrusion 76*a* extends, the annular protrusion 76*a* can be more precisely positioned relative to the frame 4.

The annular protrusion 76*a*, in the contact state thereof, encloses the two ink ejection surfaces 3*a* that are adjacent to each other with respect to the sheet-feed direction, and the main positioning hole 41*a* corresponding to the main positioning pin 61*a* is provided in a position corresponding to a midpoint of a line segment by which respective centers of the two ejection surfaces 3*a* that are enclosed with the annular protrusion 76*a* are connected with each other. Therefore, the inkjet printer 1 can enjoy a compact structure of the annular protrusion 76*a*. Further, because the center of the inner area of the annular protrusion 76*a* is aligned in the vertical direction with the midpoint of the line segment by which the respective centers of the two ejection surfaces 3*a* are connected with each other, a press force by which the annular protrusion 76*a* in the contact state presses the head frame 4*a* can be uniformed.

In addition, the respective distal ends of the main positioning pin 61*a* and the sub positioning pins 61*b* are located in positions more remote from the bottom plate portion 76*b* than the distal end of the annular protrusion 76*a*, so that in the capping operation, the annular protrusion 76*a* is come into contact with the head frame 4*a* after positioning of the annular protrusion 76*a* relative to the head frame 4*a* is finished. Thus, the annular protrusion 76*a* is prevented from being shifted in position after the annular protrusion 76*a* is come into the head frame 4*a*.

Further, since the sub positioning holes 41*b* are located adjacent to the ink ejection surfaces 3*a*, the ink ejection surfaces 3*a* can be fluid-tightly closed more certainly.

Furthermore, a degree of hardness of the positioning pins 61*a*, 61*b* is larger than that of the annular protrusion 76*a*, so that, while the cap 76 is precisely positioned relative to the head frame 4*a*, the ink ejection surfaces 3*a* are fluid-tightly covered in a state in which the annular protrusion 76*a* is come into contact with the head frame 4*a* by a light press force.

Because the bottom plate portion 76*b* including the positioning pins 61*a*, 61*b* and the annular protrusion 76*a* are formed by the plurality of times of molding, a manufacturing process of the positioning pins 61*a*, 61*b* and the annular protrusion 76*a* can be simplified.

When the main positioning pin 61*a* is inserted into the main positioning hole 41*a* in the contact state, an inner circumferential surface of the O-ring 41*c* and an outer circumferential surface of the main positioning pin 61*a* are in contact with each other such that the main positioning hole 41*a* is fluid-tightly closed, so that an ink intrusion into a side of the main body of the inkjet head 2 through the main positioning hole 41*a* is prevented.

The present invention is not limited to the present embodiment. It is to be understood that the present invention may be embodied with various changes and modifications that may occur to a person skilled in the art, without departing from the spirit and scope of the invention defined in the appended claims. For example, in the illustrated embodiment, in the inner area of the annular protrusion 76*a*, the main positioning pin 61*a* is provided in the center of the inner area, while the sub positioning pins 61*b* are respectively provided in the positions that are point-symmetric with respect to the main positioning pin 61*a*. Instead of the illustrated embodiment, the respective positioning pins 61*a*, 61*b* may be provided in any positions in the inner area. Accordingly, the inkjet heads 2, the respective positioning pins 61*a*, 61*b* and the positioning holes 41*a*, 41*b* that correspond to the positioning pins 61*a*, 61*b* can be freely positioned.

In the illustrated embodiment, the three positioning pins 61*a*, 61*b* are provided in the inner area of the annular protrusion 76*a*. One, two, or four or more positioning pins may be provided in the inner area of the annular protrusion 76*a*.

The illustrated embodiment has a structure in which each of the positioning pins 61*a*, 61*b* has a cylindrical shape, however, each of the positioning pins 61*a*, 61*b* may have any cross-sectional shape. For example, each of the positioning pins 61*a*, 61*b* may have a triangle or a quadrangle shape in cross section. In this case, it is desirable that each of the positioning holes 41*a*, 41*b* has such a cross-sectional shape depending on a cross-sectional shape of the corresponding one of the positioning pins 61*a*, 61*b*. Accordingly, the positioning pins 61*a*, 61*b* can be smoothly inserted into the positioning holes 41*a*, 41*b* and the capping operation can be surely completed.

In the illustrated embodiment, each of the sub positioning holes 41*b* into which the sub positioning pins 61*b* are inserted is the elongate hole extending in the direction away from the main positioning hole 41*a*. Instead of this structure, each of the positioning holes 41*b* may have a circular opening.

The illustrated embodiment has a structure in which the annular protrusion 76*a* encloses the two ink ejection surfaces 3*a* that are adjacent to each other in the sheet-feed direction B, however, the annular protrusion 76*a* may enclose three or more ink ejection surfaces 3*a*. In this case, it is desirable that a (main) positioning hole corresponding to a (main) positioning pin as a basis is provided near a center of the three or more ink ejection surfaces 3*a* to the utmost.

In the illustrated embodiment, the respective distal ends of the positioning pins 61*a*, 61*b* are located in the positions more remote from the bottom plate portion 76*b* than the distal end of the annular protrusion 76*a*. Instead of this, the respective distal ends of the positioning pins 61*a*, 61*b* may be located in positions nearer to the bottom plate portion 76*b* than the distal end of the annular protrusion 76*a*, or the respective distal ends of the positioning pins 61*a*, 61*b* and the annular protrusion 76*a* may be located in positions remote from the bottom plate portion 76*b* by the same distance.

In the illustrated embodiment, a degree of hardness of the positioning pins 61*a*, 61*b* is larger than that of the annular protrusion 76*a*. A degree of hardness of the positioning pins 61*a*, 61*b* may be smaller than that of the annular protrusion 76*a*, or the positioning pins 61*a*, 61*b* and the annular protrusion 76*a* may have the same degree of hardness.

In the illustrated embodiment, the O-ring 41*c* for fluid-tightly closing the main positioning hole 41*a* is provided in the main positioning hole 41*a*. Such closing member as the O-ring 41*c* may be provided in a positioning pin, or the closing member may be omitted.

In the illustrated embodiment, the two inkjet heads 2 form one set of the inkjet heads 2 corresponding to a kind of ink. Instead of this, three or more inkjet heads 2 may form one set of the inkjet heads 2 corresponding to a kind of ink.

In the illustrated embodiment, the waste ink in the purging operation is received by the cap 76. Instead of this, ink ejected through the nozzles 3*b* in the other operations in addition to the purging operation may be received by the tray 71. For example, in the purging operation, while the tray 75 is remained in the retracted position, the tray 71 moves to the maintenance position to receive the ejected ink. The ejected ink flows from the tray 71 to the waste ink tray 77 so as to be discharged outside. After the purging operation, as shown in FIG. 7B, while the tray 71 is moved to the retracted position, a removal of ink remained on the ink ejection surface 3*a* may be performed by the ink receiving member 73 and the wiper 72. Therefore, there is not required an operation in which the tray 75 (the cap 76) is disengaged from the tray 71. After the tray 71 is moved to the retracted position, if it is required to prevent an increase of viscosity of ink, the above-mentioned capping operation may be performed. In other words, the cap 76 is used for mainly preventing the increase of viscosity of ink. Accordingly, the cap 76 is free from being soiled with ink, so that the ink ejection surface 3*a* is always closed by the clean cap 76 and the nozzles 3*b* are prevented from being soiled with soiled things in the cap 76.

In addition, the illustrated embodiment has a structure in which the inkjet heads 2 are moved by the frame moving device 51 in the capping operation. Instead of this, such a structure may be adopted that the tray 75 is moved in the capping operation.

Figure 8:
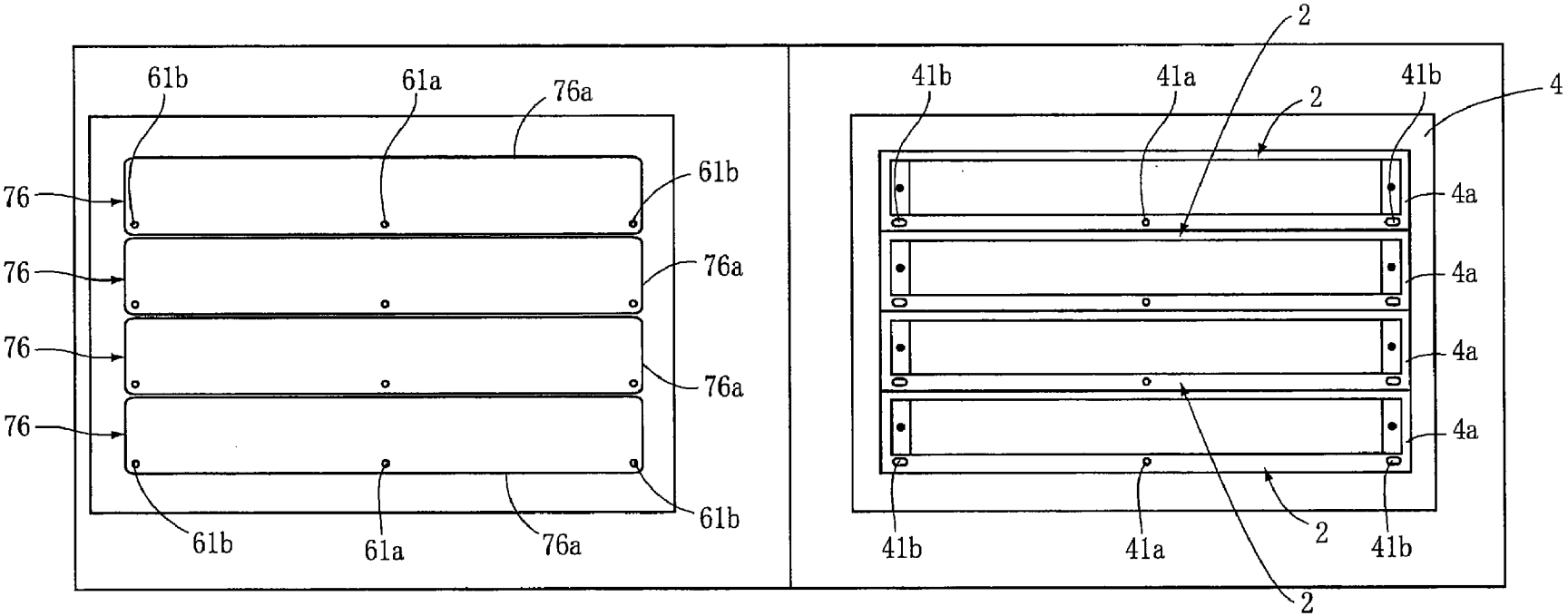
FIG. 8 is a plan view schematically showing a pertinent structure of an inkjet printer as another embodiment to which the present invention is applied.

In the illustrated embodiment, the plurality of inkjet heads 2 are arranged in the staggered manner in the perpendicular direction perpendicular to the extending direction in which the inner area of the annular protrusion 76*a* extends, however, this is not essential. For example, as shown in FIG. 8, each of the plurality of inkjet heads 2 has a length that is larger than one half of a length of the inner area in the extending direction thereof and is located in the same position with respect to the extending direction. As shown in FIG. 8, each inkjet head has a length that is a little smaller than a length of the inner area of the annular protrusion 76*a* in the extending direction. In this embodiment, it is desirable that one main positioning pin 61*a* and at least one sub positioning pin 61*b* are arranged in the extending direction in positions adjacent to the ink ejection surface 3*a* that is enclosed with the annular protrusion 76*a* in the direction perpendicular to the extending direction. In the present embodiment, each of the sub positioning pins 61*b* is provided in one of opposite end portions of the inner area of the annular protrusion 76*a*, and one main positioning hole 41 and the two sub positioning holes 41*b* are arranged corresponding to the main positioning pin 61*a* and the sub positioning pin 61*b*

In the illustrated embodiment shown in FIG. 8, one annular protrusion 76*a* may enclose the two or more ink ejection surfaces 3*a*. In this case, it is desirable that the main positioning pin 61*a* and the sub positioning pins 61*b*, the main positioning hole 41*a* and the sub positioning holes 41*b* are respectively provided in an area between the two ink ejection surfaces 3*a* that are adjacent to each other.

What is claimed is:

1. A recording apparatus comprising:

a plurality of recording heads each of which includes an ejection surface to which a plurality of nozzles open;

a head frame which has a plurality of through holes at arrangement positions where the plurality of recording heads are arranged and which supports the plurality of recording heads in a state in which the respective ejection surfaces of the recording heads are exposed through the respective through holes;

at least one annular protrusion which encloses at least one of the ejection surfaces of the plurality of recording heads that is exposed through the head frame in a state in which the at least one annular protrusion is held in contact with the head frame;

a support tray which supports the at least one annular protrusion and cooperates with the at least one annular protrusion to cover the at least one of the plurality of ejection surfaces; and a moving device which moves at least one of the head frame and the support tray such that the head frame and the annular protrusion are selectively positioned in either one of a spaced state in which the head frame and the annular protrusion are spaced from each other, and a contact state in which the head frame and the annular protrusion are held in contact with each other;

wherein one or more positioning pins are provided in an inner area of the support tray that is enclosed with the annular protrusion, the positioning pins extending in a direction perpendicular to a flat surface which includes a contact portion of the annular protrusion that is come into contact with the head frame, and wherein the head frame has one or more positioning holes into which the positioning pins are insertable in the contact state of the annular protrusion.

2. The recording apparatus according to claim 1, wherein the one or more positioning pins include a plurality of positioning pins which are respectively provided in a plurality of positions that are substantially point-symmetric with respect to a center of the inner area of the support tray.

3. The recording apparatus according to claim 1, wherein the one or more positioning pins include one positioning pin which is provided substantially in a center of the inner area of the support tray.

4. The recording apparatus according to claim 3, wherein the inner area of the support tray extends in one direction, wherein the one or more positioning pins include, in addition to a main pin as the positioning pin that is provided substantially in the center of the inner area of the support tray, one or more sub pins that are provided in one or more positions except the center of the inner area, and wherein the one or more positioning holes include, in addition to a main positioning hole as the positioning hole into which the main pin is insertable, one or more sub positioning holes into which the one or more sub pins are insertable and which consist of one or more elongate holes that extend in a direction away from the center of the inner area.

5. The recording apparatus according to claim 4, wherein the one or more sub pins include a plurality of sub pins that are provided in the vicinity of respective ends of the inner area of the support tray in the one direction in which the inner area extends.

6. The recording apparatus according to claim 1, wherein the plurality of recording heads are arranged in a staggered manner in a perpendicular direction perpendicular to an extending direction in which the ejection surfaces extend, wherein the recording apparatus includes one set of the recording heads that are arranged in the staggered manner, and wherein the at least one annular protrusion includes one annular protrusion which encloses the one set of the recording heads in the contact state of the annular protrusion.

7. The recording apparatus according to claim 6, wherein the set of recording heads include two of the recording heads that are arranged in the staggered manner, wherein the one or more positioning pins include one positioning pin that is provided substantially in the center of the inner area of the support tray, wherein the one or more positioning holes include one positioning hole that corresponds to the one positioning pin that is provided substantially in the center of the inner area, and wherein the one positioning hole is provided in a position substantially corresponding to a midpoint of a line segment by which respective centers of the two ejection surfaces that are enclosed with the annular protrusion are connected with each other.

8. The recording apparatus according to claim 1, wherein the plurality of recording heads are arranged in a staggered manner in a perpendicular direction perpendicular to an extending direction in which the ejection surfaces extend, wherein the recording apparatus includes a plurality of sets of the recording heads each of which includes two or more recording heads, wherein the at least one annular protrusions include a plurality of annular protrusions corresponding to the plurality of sets of the recording heads.

9. The recording apparatus according to claim 8, wherein each of the plurality of sets of the recording heads includes two of the recording heads which are arranged in the staggered manner, wherein, in each of the plurality of sets of the recording heads, the one or more positioning pins include one positioning pin that is provided substantially in a center of the inner area of the support tray, wherein the one or more positioning holes include one positioning hole which corresponds to the one positioning pin that is provided in the center of the inner area, and wherein the one positioning hole is provided in a position substantially corresponding to a midpoint of line segment by which respective centers of the two ejection surfaces that are enclosed with the annular protrusion are connected with each other.

10. The recording apparatus according to claim 1, wherein the one or more positioning pins include one main pin and at least one sub pin that are distant from each other with respect to a direction in parallel with the extending direction in which the inner area extends, and wherein the one or more positioning holes include (1) a main positioning hole into which the main pin is insertable and has a circular shape in cross section and (2) at least one sub positioning hole into which the at least one sub pin is insertable and is elongate in the direction in parallel with the extending direction of the inner area.

11. The recording apparatus according to claim 10, wherein the one main pin is provided substantially in a middle of the inner area of the support tray in the extending direction of the inner area, and the at least one sub pin is provided in the vicinity of opposite ends of the inner area in the extending direction of the inner area.

12. The recording apparatus according to claim 10, wherein each of the plurality of recording heads has a length that is larger than one half of a length of the inner area in the extending direction thereof and the plurality of recording heads are located in the same position with respect to the extending direction thereof, and wherein the one main pin and the at least one sub pin are provided in positions located on a line parallel to the extending direction of the inner area and are provided in positions adjacent to the ejection surface that is enclosed by the annular protrusion in a direction perpendicular to the extending direction.

13. The recording apparatus according to claim 1, wherein, in the spaced state, a distal end of the positioning pin is located in a position more remote from the support tray than a distal end of the annular protrusion.

14. The recording apparatus according to claim 1, wherein the one or more positioning holes are located adjacent to the ejection surface within a surface including the ejection surface.

15. The recording apparatus according to claim 1, wherein a degree of hardness of the positioning pins is larger than that of the annular protrusion.

16. The recording apparatus according to claim 15, wherein the support tray and the positioning pins are formed integrally with each other by molding.

17. The recording apparatus according to claim 1, wherein the support tray including the positioning pins and the annular protrusion are formed integrally with each other by a plurality of times of molding.

18. The recording apparatus according to claim 1, wherein a sealing member is provided at either one of at least one positioning pin and at least one positioning hole that correspond to each other in the one or more positioning pins and the one or more positioning holes and functions to seal a clearance between the positioning pin and the positioning hole corresponding to each other in the contact state.

19. The recording apparatus according to claim 1, wherein at least one of the one or more positioning holes is a closed hole.

20. The recording apparatus according to claim 19, wherein, in a state in which one of the one or more positioning pins corresponding to the closed hole is come into contact with a bottom of the closed hole in the contact state, an insert limit of the positioning pin into the closed hole is determined.

21. The recording apparatus according to claim 1, wherein at least one of the one or more positioning holes is an elongate hole extending in parallel with a line on the ejection surface and forms a closed hole in a state in which an upper end portion of the elongate hole is closed.

* * * * *